United States Patent [19]

Brieger

[11] 4,122,899

[45] Oct. 31, 1978

[54] WELL PERFORATOR WITH ANCHOR AND METHOD

[76] Inventor: Emmet F. Brieger, General Delivery, Nogal, N. Mex. 88341

[21] Appl. No.: 822,556

[22] Filed: Aug. 8, 1977

[51] Int. Cl.[2] ..... E21B 43/119; E21B 40/00

[52] U.S. Cl. ..... 166/297; 166/209; 102/21.8; 175/4.52

[58] Field of Search ..... 166/212, 217, 297, 206, 166/209-211; 175/4.52; 102/21.8

[56] References Cited

U.S. PATENT DOCUMENTS

| | | | |
|---|---|---|---|
| 1,875,583 | 9/1932 | Fox | 166/217 |
| 2,108,174 | 2/1938 | Mays | 166/212 |
| 2,141,030 | 12/1938 | Clark | 166/212 |
| 2,897,898 | 8/1959 | Wynn | 166/212 |
| 3,602,306 | 8/1971 | Alexander, Jr. | 166/217 |
| 3,669,187 | 6/1972 | Alexander, Jr. | 166/217 |

*Primary Examiner*—Ernest R. Purser

*Attorney, Agent, or Firm*—Marcus L. Bates

[57] ABSTRACT

A cased borehole has a tubing string run downhole thereof. A packer affixed to the tubing is set with the tubing string terminating in proximity of a hydrocarbon producing formation to be completed. A wireline operated perforating gun is suspended from a mass by means of a lost motion coupling and the mass is suspended from a wireline. The entire apparatus is run downhole and positioned adjacent to the hydrocarbon containing formation. The gun is detonated; whereupon formation fluid enters the casing and tends to thrust the gun uphole respective to the mass and to the wireline. The relative motion between the gun and mass is advantageously used to set a tool hold down apparatus which arrests uphole thrust of the gun. The gun can be subsequently retrieved by lifting the mass with the wireline, thereby releasing the tool hold down apparatus and enabling wireline retrieval of the entire apparatus suspended from the wireline.

9 Claims, 8 Drawing Figures

WELL PERFORATOR WITH ANCHOR AND METHOD

BACKGROUND OF THE INVENTION

When completing a well with a through tubing type perforating gun, it has heretofore not been possible to backsurge the perforations with more than a few hundred pounds per square inch differential from the formation toward the wellbore. This is because the more desirable higher surging pressure will blow the gun uphole, thereby tangling the cable and causing extreme difficulty in removing the gun and cable from the wellbore. Several thousand pounds per square inch differential pressure is required to properly backsurge perforations sufficiently to completely remove debris and compaction from the perforations as is done for example by the tubing conveyed system of completions, Vann U.S. Pat. No. 3,706,344.

It would be desirable to have made available a wireline operated through tubing perforating gun which can be employed for completing a wellbore and which further includes means by which the gun is prevented from being thrust uphole when the perforations are surged with several thousand pounds per square inch differential.

SUMMARY OF THE INVENTION

This invention contemplates method and apparatus for use in completing hydrocarbon producing formations located downhole in a borehole. The method comprises completing a cased well which has a tubing string extending from a wellhead downhole towards and terminating short of a hydrocarbon containing formation, with a packer device separating the casing annulus from the lower borehole. A wireline actuated perforating gun has a tool hold-down apparatus associated therewith and the entire apparatus is run downhole on a wireline and positioned adjacent to a hydrocarbon containing formation.

The gun is detonated, thereby perforating the casing and communicating the casing interior with the hydrocarbon containing formation. The tubing preferably is opened to atmosphere and accordingly the entire formation pressure is available to develop a tremendous pressure differential across the perforations. This powerful flow of liquid and gaseous products clean foreign debris from the perforations and furthermore enlarge and enhance the size of the openings originally formed by the gun.

The initial powerful surge of flow from the production zone commences lifting the gun apparatus uphole and this motion is advantageously used to set the tool hold-down apparatus of the present invention, thereby arresting uphole travel of the gun and apparatus. The tool can be subsequently removed by utilizing the wireline to cause release of the hold-down apparatus after the well has been cleaned up.

The tool hold-down apparatus includes a mandrel connected to the wireline and telescopingly received within an upper marginal end of a skirt. The skirt is attached to the gun with there being a lost motion coupling formed between the mandrel and the gun skirt. A latch means is operatively connected between the skirt and the mandrel so that relative motion therebetween sets the latch means against the interior of the casing, thereby preventing uphole thrust of the tool string.

A primary object of the present invention is to provide both method and apparatus for completing wellbores using a wireline actuated perforating gun.

Another object of the present invention is to provide improvements in a hold-down tool by which a perforating gun is prevented from being thrust uphole.

Still another object of this invention is the provision of a wireline tool having a hold-down apparatus associated therewith which is actuated in response to the tool being thrust uphole.

A still further object of this invention is the provision of a wireline actuated perforating gun and tool hold-down combination which utilizes uphole thrust of the tool string to set the hold-down, and which is wireline retrievable.

These and various other objects and advantages of the invention will become readily apparent to those skilled in the art upon reading the following detailed description and claims and by referring to the accompanying drawings.

The above objects are attained in accordance with the present invention by the provision of a method of well completion for use with apparatus fabricated in a manner substantially as described in the above abstract and summary.

DETAILED DESCRIPTION OF THE PREFERRED EMBODIMENTS

Figure 1:
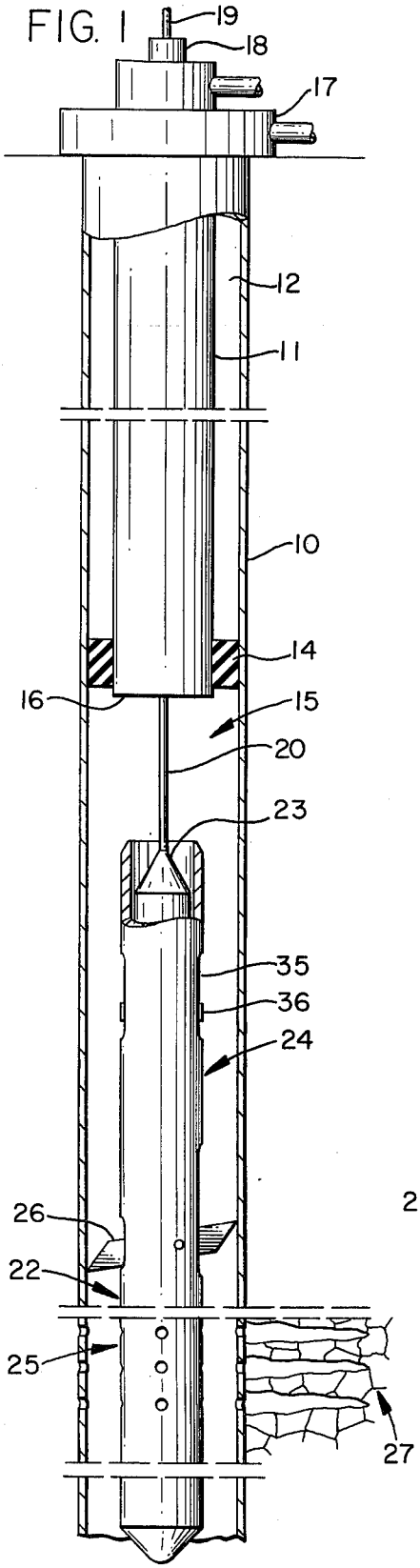
FIG. 1 is a diagrammatical representation of a longitudinal cross-section of the earth disclosing a borehole having apparatus made in accordance with the present invention associated therewith.

FIG. 1 discloses a cased wellbore 10 within which there is concentrically disposed a production tubing string 11 thereby leaving annulus 12 therebetween. Packer 14 separates the lower borehole 15 from the annulus. The tubing string terminates at 16 at a location above the bottom of the borehole. Christmas tree or wellhead 17 is of the usual design and includes a lubricator 18 attached thereto for sealingly receiving a wireline 19 therein so that the illustrated tool string can be run into the wellbore.

The wireline extends downhole as seen at 20 and is attached to the tool 22 of the present invention by means of a socket 23. The upper marginal end of the tool is in the form of an arresting and anchoring apparatus 24 while the lower marginal end 25 is in the form of a perforating gun apparatus. Latch 26 is shown pivoted into engagement with the inside peripheral wall surface of the casing. The shaped charges of the gun are seen to be positioned adjacent to a hydrocarbon containing formation 27.

Figure 2:
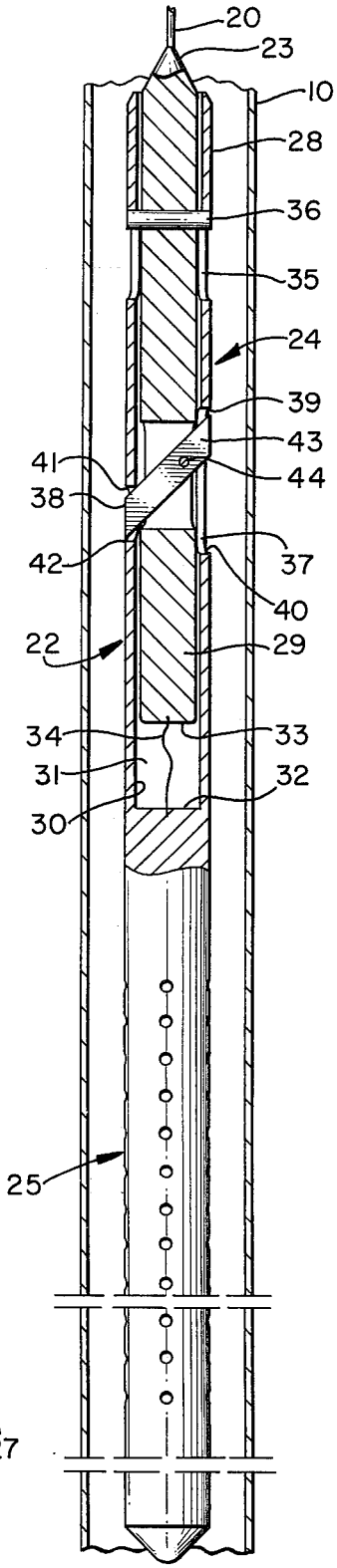
FIG. 2 is a broken, longitudinal; part cross-sectional view of a tool hold-down apparatus made in accordance with the present invention.

In Fig. 2 the arresting and anchoring apparatus of the present invention is seen to include an outer sleeve or skirt 28 which circumferentially extends about and telescopingly receives a weighted mandrel 29 with the lower marginal end of the mandrel being telescopingly received in a slidable manner within the upper marginal end of the skirt. The id 30 of the skirt together with the mandrel therefore forms a variable chamber 31. The skirt is formed by a counter bore which terminates at 32. The lower end 33 of the mandrel is spaced from wall 32.

Electrical conductor 34 extends from the wireline, down through the mandrel, and to the perforating gun. Upper slots 35 are formed in opposed sidewalls of the skirt and are aligned in opposition to one another and extend along a limited vertical length of the tool. Upper pin 36 is affixed to the mandrel and extends outwardly therefrom and into slidable engagement with the slots 35 so that opposed marginal ends of the pin abuts the upper and lower extremity of the slots thereby forming a lost motion coupling between the mandrel and the sleeve.

Opposed lower slots underlie the upper slots and includes a long slot 37 diametrically opposed to a short slot 38. The long slot terminates at 39 and 40 while the short slot terminates at 41 and 42. The latch 26 includes a lost motion coupling between the mandrel and the skirt.

Figure 3:
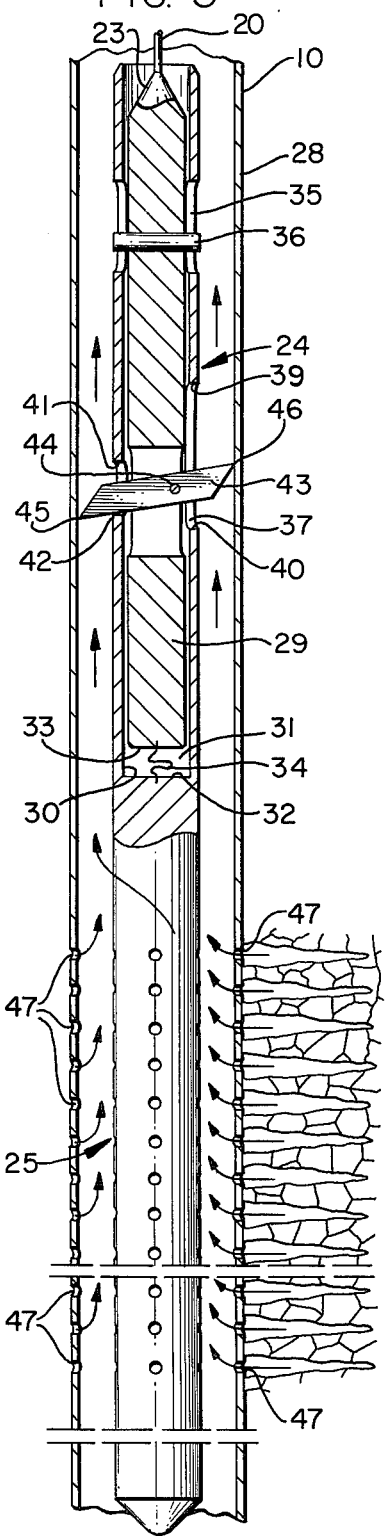
FIG. 3 is a longitudinal; part cross-sectional view of the apparatus disclosed in FIG. 2, with the apparatus thereof being shown in an alternate configuration.
Figure 4:
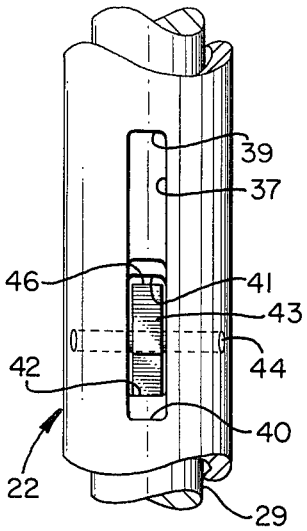
FIG. 4 is an enlarged, isolated, detailed view of part of the apparatus seen in FIG. 3.

As seen in FIGS. 3 and 4, the latch includes sharpened opposed end portions 45 and 46 which are spaced apart from one another and arranged to be pivoted into engagement with the inside peripheral wall surface of the casing such that the sharpened ends slightly imbed into the casing wall in the illustrated manner of FIGS. 1, 3, 5, and 6. Perforations 47 are formed by the action of the jet gun and extend back up into the formation 27.

Figure 5:
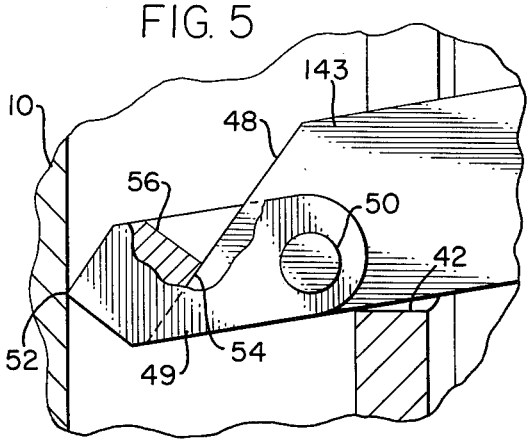
FIGS. 5 and 6 are enlarged, broken, part cross-sectional representations illustrating some of the details of the apparatus of FIG. 3.
Figure 6:
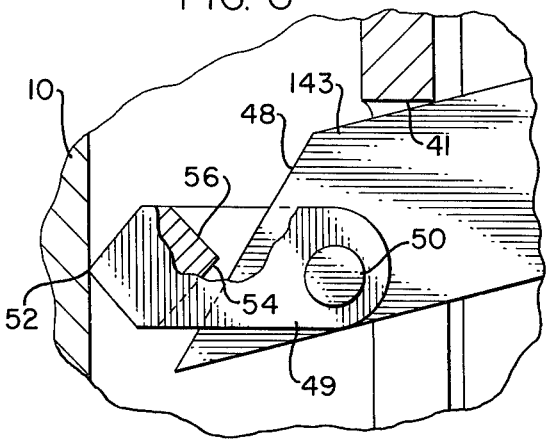

As particularly disclosed in the modification of FIGS. 5 and 6, the latch 143 has a sloped edge portion 48 which cooperates with link 49. Pin 50 pivotally attaches the link to the marginal end of the latch. The link terminates in a sharp pivoted end 52 and a shoulder 54 is formed thereon which forms a stop which is abuttingly received against the sloped portion 48 of the latch. Stop member 56 likewise abuttingly engages the sloped portion 48 when the link is pivoted in the opposed direction.

Where deemed desirable, both ends 45 and 46 of the latch 26 can be provided with the link 49 in order to enhance release of the latch assembly. The link provided on end 46 is placed in an inverted position as compared to the position of the link located on end 45, and pivots downward with respect to the latch, whereas the link on end 45 pivots upward with respect to the latch. The link on end 46 can be retained against the sloped edge portion of the latch by a suitable spring arrangement, in order to prevent the link from prematurely pivoting downward with respect to the latch. A similar spring retaining force can be applied to the link on end 45 if desired.

It is furthermore possible to employ a shear pin to hold the link against the latch. The shear pin can be made of aluminum, or the like, which will shear when the tool is lifted uphole. The shear pin can be placed through holes drilled laterally through the link and latch, as for example, a hole which is parallel to and spaced from the pin 50.

Figure 8:
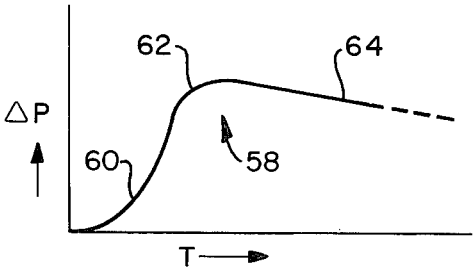
FIG. 8 is a plot of pressure versus time.

The curve 58 of FIG. 8 is a plot of pressure differential across the perforations commencing immediately upon formation of the perforations through the casing. As seen in FIG. 8, the pressure and time commences at zero, and upon detonation of the perforating gun, the pressure rises at 60 during time interval T. The pressure across the perforations continue to rise to a maximum at 62 and then commence to decrease at 64 as the reservoir driving force reaches equilibrium with the uphole back pressure conditions. The plot of FIG. 8 is a hypothetical plot for open flowing the well of FIGS. 1-3,

OPERATION

After the borehole has been drilled and the casing cemented into position, the wellhead, tubing string, and packer are assembled in the manner seen illustrated in FIG. 1.

The apparatus of the present invention is run downhole through the tubing string by utilizing a lubricator 18 which sealingly and slidably engages the wireline 19. When the jet gun is properly positioned adjacent to the hydrocarbon bearing formation, the gun is detonated, thereby penetrating the casing at 47 and forming a passageway back up into the formation.

At this time, the tubing string preferably is opened to atmosphere while the annulus 12 is filled with fluid thereby enabling a maximum pressure to be developed across the perforations and placing the packer and the end of the tubing string in the safest configuration for the resulting shock.

As the production fluid initially surges across the perforations, the downhole pressure at 60, 62 of FIG. 8 forces the tool string 22 of FIG. 1 to commence flowing uphole. Since the mandrel is slidably encapsulated in captured relationship within the skirt, it will more or less remain stationary while the gun and sleeve are forced uphole, within the confines permitted by the travel of the lost motion coupling thereof. This action causes the lowermost end of the shortest of the lower slots to engage the lower surface of the longest end of the link thereby pivoting the link in a clockwise direction in the illustrated manner of FIGS. 2 and 3. This action brings the sharp edges 45 and 46 of the link into engagement with the inside peripheral wall surface of the casing string, thereby arresting further upward motion of the tool string and anchoring the apparatus into the illustrated position of FIG. 3. Production continues from the perforations and when the well has been suitably cleaned up, the flow is reduced sufficiently to enable the wellhead to be connected into a gathering system (not shown) so that the hydrocarbons can flow on to a tank farm or sales line. During this occasion of low flow, the tool string can be removed from the lubricator since the uphole flow will be insufficient to cause up thrust of the tool string.

Figure 7:
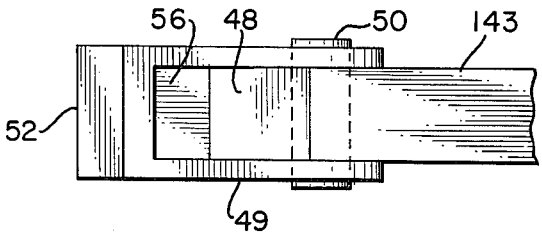
FIG. 7 discloses another view of the apparatus seen disclosed in FIG. 6.

The tool string is removed from the borehole by placing the wireline under sufficient tension to pivot the latch 26 from the illustrated position of FIG. 1 back into the running in position of FIG. 2. As the wireline is roved in, the mandrel pulls the latch at pin 44, while upper edge 41 of the upper slots bears against the long side of the latch, causing it to be pivotally released from the casing wall.

Where exceptionally high pressure differentials across the tool string are anticipated, the embodiment of FIGS. 5-7 may be employed to enhance the releasing action of the tool. This is achieved by the provision of the link 49 attached to latch 143.

As seen in FIG. 8, there is a small but finite time interval during which the full force of the formation pressure is available for cleaning out the perforations. It is desirable that this tremendous surge of pressure be utilized in removing all possible obstructions and contaminations from the perforated hydrocarbon containing formation. The tool of the present invention enables the well to be surged immediately upon firing of the jet charges, thereby developing the maximum pressure drop across the perforations.

I claim:

1. A wireline actuated perforating gun and tool hold-down apparatus comprising, in combination, a main body having an axial counter bore which forms an outer sleeve at the upper marginal end thereof, with the perforating gun being affixed at the lower end thereof;

an elongated mandrel having a marginal end thereof telescopingly received in a slidable manner within said skirt, means connecting the upper end of said mandrel to the wireline;

means forming a lost motion coupling between said mandrel and said skirt thereby enabling relative limited reciprocal motion therebetween;

a latch means affixed to said mandrel and extending through said skirt, means by which said latch means is extended into engagement with the inside peripheral wall surface of a casing to thereby arrest vertical movement of the gun when the gun moves uphole respective to the mandrel, and means by which the latch means is retracted from engagement with the inside peripheral wall surface of the pipe when the wireline moves the mandrel uphole respective to the gun.

2. The combination of claim 1 wherein said skirt includes a slot, said latch means is an enlongated member having a length slightly greater than the diameter of the pipe within which it is to be anchored, means pivotally attaching said elongated member to said mandrel with a marginal end of the elongated member extending through said slot, said slot and elongated member being arranged such that reciprocal movement between said mandrel and in one direction pivots said elongated member transversely respective to the pipe and reciprocal movement between said mandrel and skirt in the other direction pivots said elongated member longitudinally respective to the pipe.

3. Apparatus of claim 2 wherein said latch means has opposed end portions; and, a pivot pin by which it is affixed to said mandrel;

said opposed end portions having slope sidewalls which result in formation of a sharp casing engaging end.

4. The apparatus of claim 2 wherein said latch means includes a link pivotally attached to the end thereof;

stop means on said link;

said link being pivoted into engagement with the casing wall when said latch is in the extended configuration.

5. The apparatus of claim 1 wherein said lost motion coupling includes an upper slot formed within said skirt member, a pin extending through said mandrel and into registry with said slot;

so that relative motion between said mandrel and said skirt causes said pin to move from a lower to an upper extreme position within said slot.

6. In a cased borehole having a tubing string supported from a wellhead and extending downhole towards and terminating (short) in proximity of a hydrocarbon containing formation, a packer device positioned between said casing and said tubing for separating the lower borehole from the upper borehole annulus, a wireline tool hold-down system for completion of the well comprising:

an elongated mandrel attached to the wireline; a cylindrical skirt member having a lower end to which a tool can be attached, said mandrel being telescopingly received in a slidable manner within said skirt member, a lost motion coupling means formed between said skirt and said mandrel for limiting for relative longitudinal movement therebetween;

said lost motion coupling includes an upper slot formed within said skirt member, a pin extending through said mandrel and into registry with said slot;

so that relative motion between said mandrel and said skirt causes said pin to move from a lower to an upper extreme position within said slot;

latch means connected to be extended laterally into engagement with the casing when said skirt moves uphole relative to said mandrel, and to be retracted within said skirt when said mandrel moves uphole respective to said skirt;

whereby a tool can be connected to said skirt and run down through the tubing string, into a lower borehole adjacent the hydrocarbon containing formation so that should a high velocity flow of fluid occur uphole, the skirt will move uphole relative to the mandrel, thereby extending the latch means into engagement with the casing wall.

7. The tool hold-down system of claim 6 wherein said skirt includes a lower slot, said latch means is an elongated member having a length slightly greater than the diameter of the pipe within which it is to be anchored, means pivotally attaching said elongated member to said mandrel with a marginal end of the elongated member extending through said lower slot, said lower slot and elongated member being arranged such that reciprocal movement between said mandrel and in one direction pivots said elongated member transversely respective to the pipe and reciprocal movement between said mandrel and skirt in the other direction pivots said elongated member longitudinally respective to the pipe.

8. Method of completing a cased well having a tubing string extending from a wellhead downhole towards and terminating short of a hydrocarbon containing formation, with a packer device separating the casing annulus from the lower borehole, comprising the steps:

running a perforating gun and tool hold-down apparatus downhole on a wireline and positioning the gun adjacent the hydrocarbon containing formation;

detonating the perforating gun to perforate the casing thereby communicating the interior of the casing with the hydrocarbon containing formation;

immediately open flowing the well concurrently with perforating the casing to surge the perforations with the maximum available driving force, thereby flowing the gun uphole due to the pressure drop thereacross;

suspending a mass from the wireline and suspending the perforating gun from the mass by a lost motion coupling so that as the gun commences to move uphole the mass remains stationary;

using the relative motion between the gun and the mass to set a tool hold-down apparatus, thereby arresting uphole travel of the gun;

flowing the well for an interval of time in order to clean up the formation;

reducing the flow rate, thereby reducing the pressure differential across gun to a value which does not provide sufficient lift to flow the gun uphole;

lifting the mass by the wireline and using the relative motion between mass and the gun to actuate the hold-down apparatus into the released configuration;

removing the gun, mass, and hold-down apparatus from borehole by using the wireline, thereby completing the well.

9. The method of claim 8 and further including the step of using a lost motion coupling to provide limited uphole relative motion for setting the tool hold-down apparatus against the casing wall.

* * * * *

UNITED STATES PATENT OFFICE

CERTIFICATE OF CORRECTION

Patent No. 4,122,899 Dated October 31, 1978

Inventor(s) EMMET F. BRIEGER

It is certified that error appears in the above-identified patent and that said Letters Patent are hereby corrected as shown below:

Column 3, line 22, substitute --skirt-- for "sleeve";

Column 3, line 27-28, delete "lost motion coupling between the mandrel and the skirt." and insert --short end 43 which pivots vertically about pivot 44.--;

Column 5, line 13, substitute --skirt-- for "sleeve";

Column 5, line 48, substitute --sloped-- for "slope";

Column 6, line 9, substitute --the-- second occurrence for "for".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,122,899

DATED : October 31, 1978

INVENTOR(S) : Emmet F. Brieger

It is certified that error appears in the above-identified patent and that said Letters Patent are hereby corrected as shown below:

Column 5, line 66, delete "(short)"

Signed and Sealed this

*Twenty-fifth* Day of *March 1980*

[SEAL]

*Attest:*

SIDNEY A. DIAMOND

*Attesting Officer*

*Commissioner of Patents and Trademarks*